US011598618B1

(12) United States Patent
Leighton et al.

(10) Patent No.: US 11,598,618 B1
(45) Date of Patent: Mar. 7, 2023

(54) TIME DELAY SYSTEMS, METHODS, AND DEVICES

(71) Applicant: GOODRICH CORPORATION, Charlotte, NC (US)

(72) Inventors: Leo P. Leighton, Coto de Caza, CA (US); Matthew Salois, Fairfield, CA (US); Luis G. Interiano, Galt, CA (US); Kevin Mueller, Davis, CA (US)

(73) Assignee: Goodrich Corporation, Charlotte, NC (US)

( * ) Notice: Subject to any disclaimer, the term of this patent is extended or adjusted under 35 U.S.C. 154(b) by 0 days.

(21) Appl. No.: 17/496,490

(22) Filed: Oct. 7, 2021

(51) Int. Cl.
*F42C 15/184* (2006.01)
*F42C 9/10* (2006.01)
*F42C 15/31* (2006.01)

(52) U.S. Cl.
CPC ..... *F42C 15/184* (2013.01); *F42C 9/10* (2013.01); *F42C 15/31* (2013.01)

(58) Field of Classification Search
CPC .... F42C 9/10; F42C 9/12; F42C 15/18; F42C 15/184–196; F42C 15/31
See application file for complete search history.

(56) References Cited

U.S. PATENT DOCUMENTS 2,807,210 A * 9/1957 Wales, Jr. ..... F42C 15/285 102/250
2,830,538 A 4/1958 Dodge
2,963,974 A * 12/1960 Sekella ..... F42C 1/02 102/249
3,091,178 A * 5/1963 Hishoshi ..... F42C 15/30 102/230
3,728,936 A * 4/1973 Norris ..... F42C 15/30 89/1.55
3,992,999 A * 11/1976 Chevrier ..... F42C 15/31 60/632
4,328,754 A 5/1982 Goodman
5,635,667 A 6/1997 Boyer et al.

FOREIGN PATENT DOCUMENTS

FR 2594220 A1 * 8/1987 ..... F42C 15/24

OTHER PUBLICATIONS

Matthew D. Salois, et al. U.S. Appl. No. 17/359,359, filed Jun. 25, 2021, entitled "Time Delay Systems, Methods, and Devices", pp. 1-22.

* cited by examiner

*Primary Examiner* — Bret Hayes
(74) *Attorney, Agent, or Firm* — Snell & Wilmer L.L.P.

(57) ABSTRACT

A damper system for a pyrotechnic time delay may comprise: a firing pin; a moveable housing defining a chamber therein; a fixed piston comprising a piston head disposed in the chamber, a first rod extending from the piston head axially outward of the moveable housing, and a second rod configured to fixedly couple to a housing; a first spring extending axially from the moveable housing to the firing pin; and a second spring extending axially from the moveable housing to the firing pin.

20 Claims, 7 Drawing Sheets

TIME DELAY SYSTEMS, METHODS, AND DEVICES

FIELD

The present disclosure relates generally to time delay systems, methods and devices and, more particularly, to an inert time delay device with a spring damper system.

BACKGROUND

Energetic time delay systems and methods may have various manufacturing issues. Additionally, energetic time delay systems may include trial and error tests during verification and validation of a design and each production lot in order to determine the correct timing. Due to the inefficient process of design and manufacture of energetic time delay systems and methods, energetic time delay devices may be relatively expensive. Since the delay is created with energetics, there may be obsolescence issues. Additionally, energetic time delays may be a life limited part, resulting in additional cost of replacing the energetic time delay over the life of an asset, such as an aircraft or the like.

SUMMARY

A damper system for a pyrotechnic time delay is disclosed herein. The damper system may comprise: a firing pin; a moveable housing defining a chamber therein; a fixed piston comprising a piston head disposed in the chamber, a first rod extending from the piston head axially outward of the moveable housing, and a second rod configured to fixedly couple to a housing; a first spring extending axially from the moveable housing to the firing pin; and a second spring extending axially from the moveable housing to the firing pin.

In various embodiments, the damper system may further comprise a release arm assembly configured to retain the firing pin axially for a predetermined period of time during translation of the moveable housing toward the firing pin. The release arm assembly may comprise a release mechanism, the firing pin configured to release from the release arm assembly in response to the moveable housing engaging the release mechanism. The release mechanism may be a guide ramp. The chamber may be a hydraulic chamber configured to receive a working fluid. The moveable housing is configured to translate axially relative to the fixed piston. The first spring and the second spring are configured to compress in response to the moveable housing translating axially relative to the fixed piston. The firing pin may be configured to translate axially in response to the firing pin being released after, and in response to, the moveable housing translating a predetermined distance.

An inert time delay device is disclosed herein. The inert time delay device may comprise: a housing having a first axial end and a second axial end; an ignition disposed at the first axial end; a primer disposed at the second axial end; and a damper system disposed in the housing, the damper system comprising: a firing pin spaced apart axially from the primer; a moveable housing spaced apart axially from the ignition; a fixed piston comprising a piston head disposed in the moveable housing and a first rod extending from the piston head axially, and outward from, the moveable housing, the fixed piston coupled to the housing; and a first spring disposed axially between the moveable housing and the firing pin, the damper system configured to initiate an inert time delay from the ignition receiving a pyrotechnic input to the primer sending a pyrotechnic output.

In various embodiments, the damper system further comprises a release arm assembly configured to retain the firing pin in an axial position until the release arm assembly is released from the firing pin. The release arm assembly may release the firing pin in response to the moveable housing engaging a release mechanism of the release arm assembly. The release arm assembly may release the firing pin in response to the moveable housing travelling a first axial distance. The first spring may compress in response to the moveable housing traveling the first axial distance. The first spring may expand, causing the firing pin to travel a second axial distance and engage the primer in response to the release arm assembly releasing the firing pin. The moveable housing may define a hydraulic chamber configured to receive a working fluid. The inert time delay device may further comprise the working fluid disposed in the hydraulic chamber.

A method of manufacturing an inert time delay device is disclosed herein. The method may comprise: coupling a release arm assembly to a first portion of a housing; disposing a damper system in the first portion of the housing, the damper system comprising a moveable housing, a fixed piston, a first spring, a second spring, and a firing pin, the firing pin engaging the release arm assembly; coupling a second portion of the housing to the first portion of the housing; and coupling a primer to the second portion of the housing.

In various embodiments, the first spring and the second spring extend axially from the moveable housing to the firing pin. The moveable housing may comprise a hydraulic chamber disposed therein, the hydraulic chamber including a working fluid. In various embodiments, coupling the release arm assembly to the first portion may further comprise disposing a release arm spring radially through the housing to engage a release arm of the release arm assembly and coupling the release arm spring to the first portion of the housing.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Time delay devices for use with mines, demolition charges, ejection seats, or the like currently consist of cord type safety fuses, electric, electronic, and mechanical clocks, and chemical acting devices utilizing the corrosive effect of an acid on wire. Chemical type devices usually consist of a glass vial containing an acid mounted adjacent a spring loaded wire restraining a firing pin, such that when the vial is broken the acid spills over the wire and after the time delay taken for the wire to corrode through under the action of the acid the firing pin is released. Energetic time delays often involve an explosive column that burns at a specific rate. However, these devices are extremely sensitive to temperature and for the same device the time delay may vary between several hours to many days under varying conditions. Also, there is no indication how quickly the wire will break under the corrosive action, and should the glass vial be subjected to internal damage the possibility that the wire will break almost immediately can lead to serious accidents in relation to personnel handling the devices.

Disclosed herein are time delay systems and methods utilizing a spring damper system. In various embodiments, the time delay system utilizes a mechanical delay facilitated by a spring damper system instead of energetics. In various embodiments, a time delay device with the time delay system disclosed herein would be more efficient to manufacture and/or cost less relative to an energetic time delay device, in accordance with various embodiments.

Figure 1A:
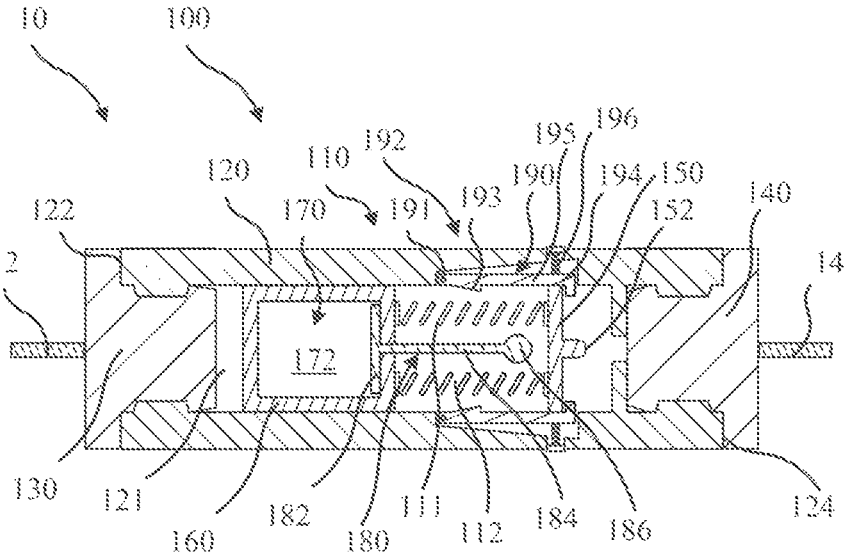
FIG. 1A illustrates a cross-sectional view of an inert time delay device, in accordance with various embodiments.
Figure 1B:
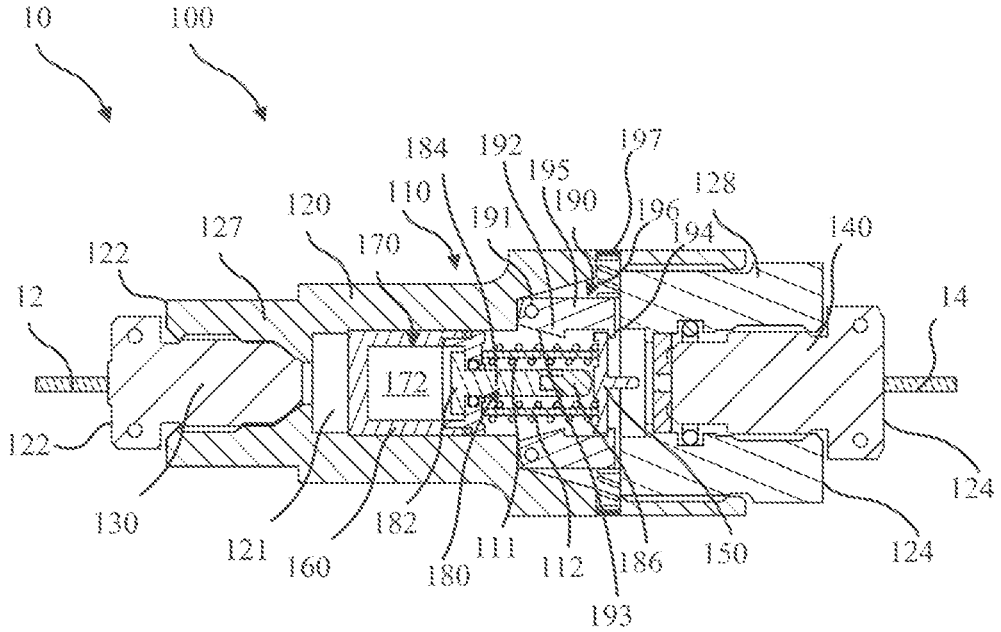
FIG. 1B illustrates a cross-sectional view of an inert time delay device, in accordance with various embodiments.

Referring now to FIGS. 1A and 1B, a cross-sectional schematic view (FIG. 1A) and a cross-sectional detailed view (FIG. 1B) of a portion of a pyrotechnic system 10 with an inert time delay device 100 having a damper system 110 is illustrated, in accordance with various embodiments. The inert time delay device 100 is inert (i.e., chemically inactive), in accordance with various embodiments. In this regard, a life of the time delay system may be extended relative to typical time delay systems with pyrotechnic inputs and outputs.

In various embodiments, having the inert time delay device 100 is configured to couple to an input explosive transfer line ("ETL") 12 and an output ETL 14. In this regard, the inert time delay device 100 is configured to generate a time delay from receiving an input signal from the input ETL 12 to outputting a signal to the output ETL 14. In various embodiments, the inert time delay device 100 is adaptable for any pyrotechnic system 10 configured for a predetermined time delay between an ETL being imitated and a firing device being initiated, such as demolition, fireworks, launch vehicle payload deployment systems, explosives in mining, or the like.

In various embodiments, the inert time delay device 100 comprises a housing 120 having a first end 122 and a second end 124, a low energy ("LE") ignition 130, a primer 140, and the damper system 110. "Low energy ignition" or "gas generator ignition" ("GG") as defined herein is a term of art referring to an ignition configured to generate a pressure front event at an output energy between 1 and 1000 Joules, or between 1 and 100 Joules, or approximately 10 Joules, in accordance with various embodiments.

In various embodiments, the LE or GG ignition 130 is disposed at the first end 122 of the housing 120 and the primer 140 is disposed at the second end 124 of the housing 120. The second end 124 is disposed opposite the first end 122. In various embodiments, the housing 120 may be cylindrical, cuboidal, or the like. The damper system 110 is disposed within the housing 120 and configured to generate a predetermined time delay from receiving an ignition at LE or GG ignition 130 at first end 122 and releasing a firing pin 150 into the primer 140 at second end 124.

In various embodiments, the damper system 110 comprises a first spring 111, a second spring 112, the firing pin 150, a moveable housing 160, a hydraulic chamber 170, and a fixed piston 180, and a release arm assembly 190. The housing 120 defines a chamber 121 extending from the first end 122 to the second end 124 of the housing 120. In various embodiments, the moveable housing 160 is disposed within the chamber 121 and spaced apart axially from the LE or GG ignition 130. The hydraulic chamber 170 is disposed within the moveable housing 160.

In various embodiments, in response to LE or GG ignition 130 being ignited, the LE or GG ignition 130 may generate a flame and pressure between the LE or GG ignition 130 and the moveable housing 160 in the chamber 121. In various embodiments, as described further herein, the pressure generated from the LE or GG ignition 130 results in a force being applied on the moveable housing 160 towards the second end 124 of the housing 120, which results in the moveable housing 160 translating axially towards the second end 124 of the housing 120 and compressing the springs 111, 112 until the firing pin 150 is released, causing the firing pin to translate towards the primer 140.

Figure 8:
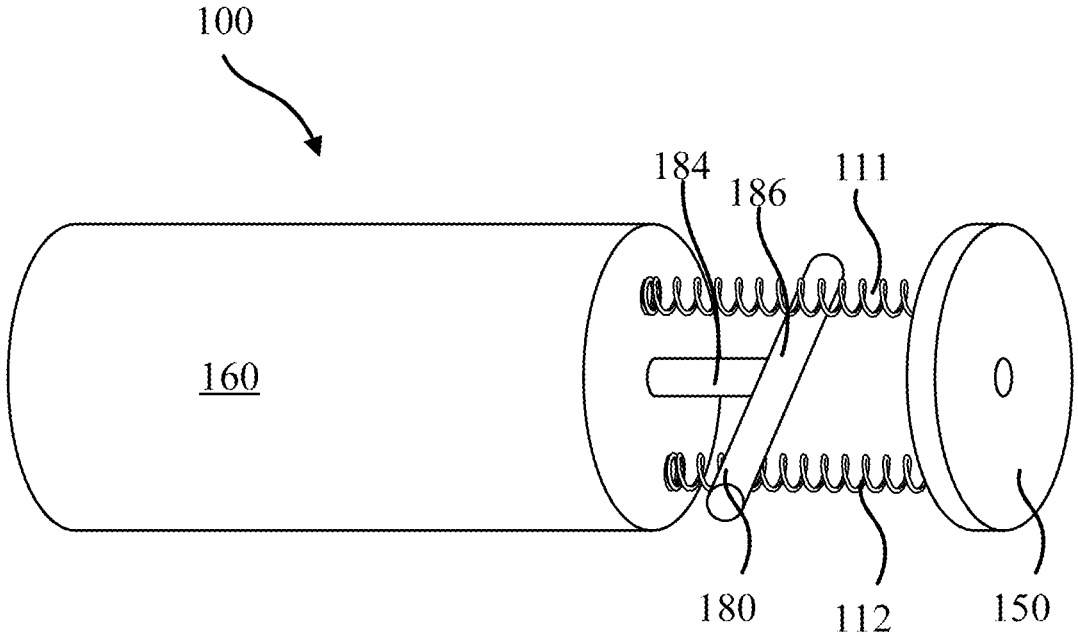
FIG. 8 illustrates a perspective view of a portion of an inert time delay device, in accordance with various embodiments.

In various embodiments, and with combined reference to FIGS. 1A, 1B, and 8, the fixed piston 180 comprises a piston head 182, a first rod 184 and a second rod 186. The first rod 184 extends axially away from the piston head 182 toward the second end 124 of the housing 120 to the second rod 186. The second rod 186 extends radially through the chamber 121. In various embodiments, the piston head 182 is disposed in the hydraulic chamber 170. In this regard, the piston head 182 may further comprise apertures disposed therethrough to allow fluid communication between sides from one side of the piston head 182 to the other side of the piston head 182 during operation of the inert time delay device 100 as described further herein. In various embodiments, the second rod 186 is coupled to the housing 120. In this regard, the second rod 186 fixes the fixed piston 180 during operation of the inert time delay device 100. The springs 111, 112 are disposed radially outward from the first rod 184 and disposed axially between the moveable housing 160 and the firing pin 150. Due to the second rod 186 being coupled to the housing 120 at least two springs 111, 112 may be utilized for balancing a spring force during operation of the inert time delay device 100.

In various embodiments, the hydraulic chamber 170 may be sealed from the chamber 121 by any method known in the art, such as an elastomeric seal, a gasket, or the like. In this regard, a working fluid 172 disposed in the hydraulic chamber 170 is configured is fluidly isolated from the chamber 121 during operation of the damper system 110. The working fluid 172 may be any working fluid, such as water, oil, air, or any other liquid or gas, etc. In various embodiments, the working fluid 172 may be chosen based on a desired viscosity and/or a desired predetermined time delay. In this regard, the structure of the inert time delay device 100 may be maintained and only a working fluid 172 may be changed to change a delay time from a first delay time to a second delay time, in accordance with various embodiments.

In various embodiments, the firing pin 150 comprises the head 152 disposed proximate (i.e., spaced apart from) the primer 140. The firing pin 150 is coupled to the moveable housing 160 via springs 111, 112. For example, the first spring 111 and the second spring 112 each extend axially from the moveable housing 160 to the firing pin 150. In various embodiments, the springs 111, 112 are compression springs. The springs 111, 112 are installed in a neutral state (i.e., with no stored energy) or in a compressed state. The present disclosure is not limited in this regard.

In various embodiments, the release arm assembly 190 comprises a release arm 195 that is disposed radially outward from the first rod 184 of the fixed piston 180. The release arm assembly 190 is pivotably coupled to the housing 120 (e.g., via a pin or the like). The release arm assembly 190 comprises a release mechanism 192 configured to release the release arm 195 from engagement with the firing pin 150. For example, the release arm 195 comprises an engagement end 194 configured to engage the firing pin 150. In response to engaging the firing pin 150, the release arm 195 may prevent the firing pin 150 from extending past an axial position in the chamber 121 during compression of the springs 111, 112, allowing the springs 111, 112 to store energy that is released upon releasing of the release arm 195, allowing the firing pin 150 to translate towards, and make contact with, the primer 140 as described further herein. In various embodiments, the release mechanism 192 comprises a guide ramp 193 sloping radially inward into the chamber 121. As described further herein, the moveable housing 160 is configured to contact the guide ramp 193 and cause the release arm 195 to pivot about a pivot 191 radially outward to release the firing pin 150 from the release arm 195.

In various embodiments, the release arm assembly 190 further comprises a spring 196 disposed radially outward from a centerline of the housing 120 and radially between the housing 120 and the release arm 195. In various embodiments, the spring 196 is a compression spring. In an installed position, the spring 196 may bias the release arm towards the firing pin 150 to engage the firing pin 150. In this regard, the firing pin 150 may be retained axially until release of the release arm 195 as described further herein.

The inert time delay device 100 may comprise a plurality of the release arm assembly 190 disposed circumferentially about the housing 120. Any number of release arm assemblies may be disposed circumferentially about the housing 120. For example, the inert time delay device 100 may comprise between 1 and 6 release arm assemblies 195, or between 2 and 5 release arm assemblies 190, or approximately 2 release arm assemblies 190, in accordance with various embodiments.

With reference now to FIG. 1B, the housing 120 may be split into a first portion 127 and a second portion 128 to facilitate assembly. For example, the damper system 110 may be installed within the first portion 127 through an opening proximate the second end 124 of the housing 120. Then, after installation of the damper system 110, the second portion 128 of the housing 120 may be coupled to the first portion 127 by any method known in the art (e.g., threaded connection press fit, or the like). Then, the primer 140 may be coupled to the second portion 128. In various embodiments, the primer 140 may be coupled to the second portion 128 prior to coupling the second portion 128 to the first portion 127.

In various embodiments, spring 196 of a respective release arm assembly 190 may be a final component installed in the release arm assembly 190. For example, the spring 196 may be disposed through an aperture in the first portion 127 of the housing 120 and coupled to the housing 120 via welding or the like. In this regard, the spring 196 may include a fixed portion (i.e., a non-spring portion) configured to be coupled to the housing 120.

Figure 2:
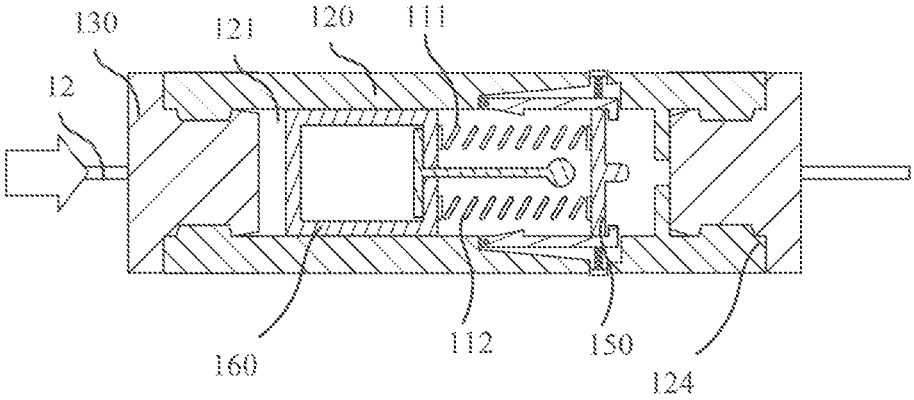
FIG. 2 illustrates a cross-sectional view of an inert time delay device during operation, in accordance with various embodiments.
Figure 3:
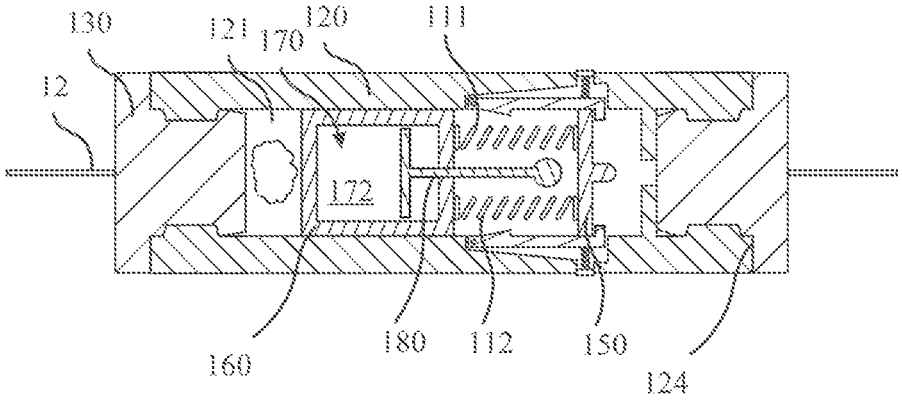
FIG. 3 illustrates a cross-sectional view of an inert time delay device during operation, in accordance with various embodiments.

Referring now to FIGS. 2 and 3, a cross-sectional view of an initial sequence of the inert time delay device 100 is illustrated, in accordance with various embodiments. As shown in FIG. 2, a time delay sequence is initiated in response to the LE or GG ignition 130 receiving a pyrotechnic input supplied via input ETL 12 axially between the LE or GG ignition 130 and the moveable housing 160. In response to the LE or GG ignition 130 receiving the pyrotechnic input, the LE or GG ignition 130 may generate a low energy spark within the chamber 121. In this regard, the pressure from the low energy spark generated by the LE or GG ignition 130 creates an axial force on the moveable housing 160, causing the moveable housing 160 to translate axially towards the second end 124 of the housing 120, compressing the springs 111, 112 between the moveable housing 160 and the firing pin 150.

In various embodiments, the moveable housing 160 translates relative to the fixed piston 180. In this regard, the hydraulic chamber 170 moves axially relative to the piston head 182 of the fixed piston 180 damping the axial motion a predetermined amount. For example, a viscosity of the working fluid 172 disposed in the hydraulic chamber 170 may be various based on a desired time delay for the inert time delay device 100.

In various embodiments, the springs 111, 112 begin being compressed in response to the moveable housing 160 moving axially towards the firing pin 150 and the firing pin 150 being retained axially by the release arm assembly 190.

Figure 4:
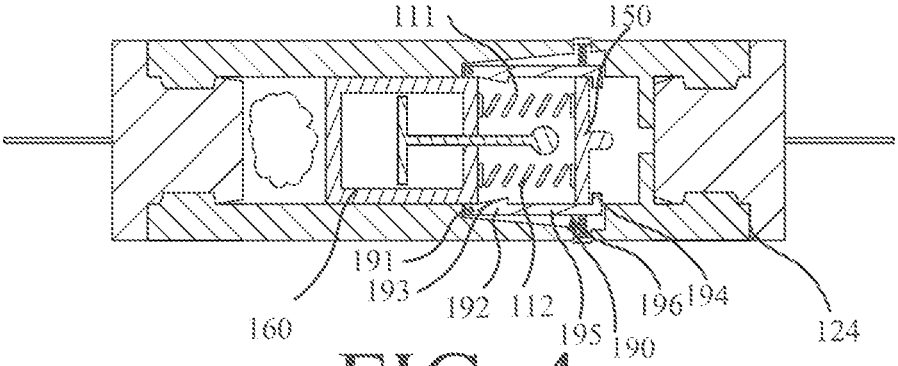
FIG. 4 illustrates a cross-sectional view of an inert time delay device during operation, in accordance with various embodiments.
Figure 5:
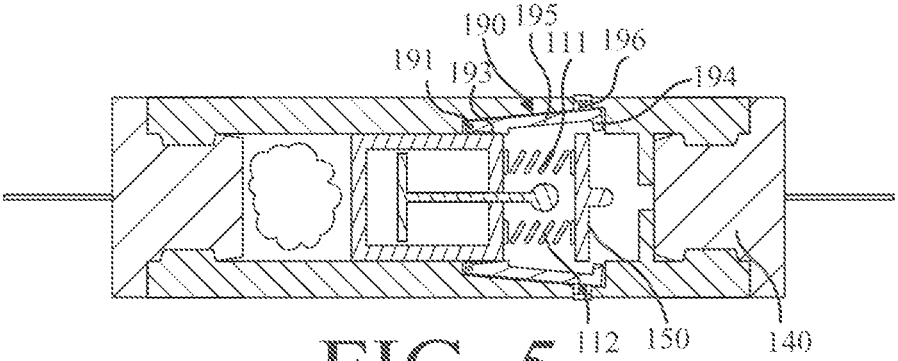
FIG. 5 illustrates a cross-sectional view of an inert time delay device during operation, in accordance with various embodiments.

With reference now to FIGS. 4 and 5, in response to translating axially within the housing 120 towards the second end 124, the moveable housing 160 engages the guide ramp 193 of the release mechanism 192. In this regard, engagement of the moveable housing 160 with the guide ramp 193 causes the release arm 195 of the release arm assembly 190 to pivot about the pivot 191 in a radially outward direction. Once the moveable housing 160 has fully engaged the guide ramp 193 (as shown in FIG. 5), the engagement end 194 of the release arm 195 disengages from the firing pin 150. Immediately after release of the release arm 195 from engagement with the firing pin 150, the springs 111, 112 are compressed to a predetermined length. Thus, the springs 111, 112 have a predetermined amount of stored energy which, when released, causes translation of the firing pin 150 toward the primer 140 (as shown in FIG. 6).

Figure 6:
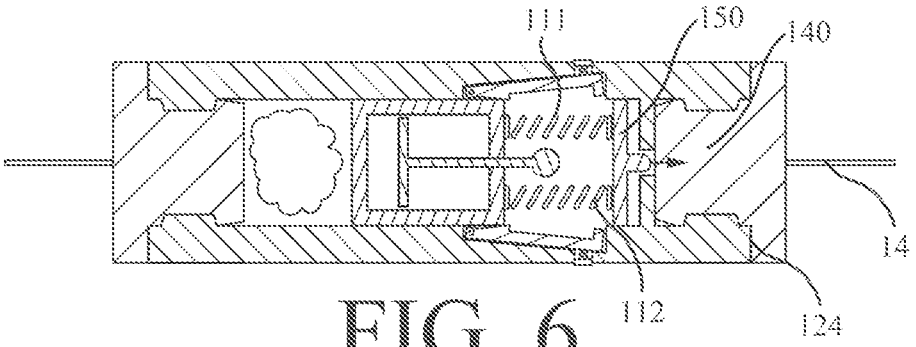
FIG. 6 illustrates a cross-sectional view of an inert time delay device during operation, in accordance with various embodiments.
Figure 7:
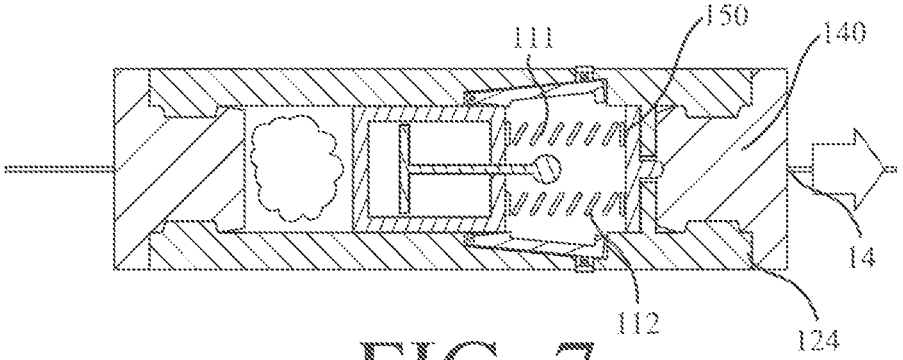
FIG. 7 illustrates a cross-sectional view of an inert time delay device during operation, in accordance with various embodiments.

Referring now to FIGS. 6 and 7, the springs 111, 112 cause the firing pin 150 to translate axially towards the second end 124 of the housing 120 causing the head 152 of the firing pin 150 to contact the primer 140 igniting a respective propellent in the primer 140, which in turn ignites an output ETL 14 and to complete a respective time delay.

In various embodiments, various aspects of the inert time delay device 100 may be sized and configured based on a predetermined time delay of the respective inert time delay device. For example, a spring having a specific spring constant may be varied in springs 111, 112 to vary a respective time delay, a fluid density of working fluid 172 from FIG. 1 may be chosen based on a desired time delay, or the like. Similarly, an axial travel distance of the moveable housing 160 may be varied or modified based on a desired time delay, or the like. In various embodiments, the mechanical aspects of the inert time delay device 100 may provide limited variations in a respective time delay compared to electronic time delay devices or other typical electronic device, in accordance with various embodiments. Similarly, due to the mechanical nature of the inert time delay device 100, less testing, and/or lower cost, relative to typical time delay devices may be achieved.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

What is claimed is:

1. A damper system for a pyrotechnic time delay, comprising:

a firing pin;

a moveable housing defining a chamber therein;

a fixed piston comprising a piston head disposed in the chamber, a first rod extending from the piston head axially outward of the moveable housing, and a second rod configured to fixedly couple to a housing;

a first spring extending axially from the moveable housing to the firing pin; and a second spring extending axially from the moveable housing to the firing pin.

2. The damper system of claim 1, further comprising a release arm assembly configured to retain the firing pin axially for a predetermined period of time during translation of the moveable housing toward the firing pin.

3. The damper system of claim 2, wherein the release arm assembly comprises a release mechanism, the firing pin configured to release from the release arm assembly in response to the moveable housing engaging the release mechanism.

4. The damper system of claim 3, wherein the release mechanism is a guide ramp.

5. The damper system of claim 1, wherein the chamber is a hydraulic chamber configured to receive a working fluid.

6. The damper system of claim 1, wherein the moveable housing is configured to translate axially relative to the fixed piston.

7. The damper system of claim 6, wherein the first spring and the second spring are configured to compress in response to the moveable housing translating axially relative to the fixed piston.

8. The damper system of claim 7, wherein the firing pin is configured to translate axially in response to the firing pin being released after, and in response to, the moveable housing translating a predetermined distance.

9. An inert time delay device, comprising:

a housing having a first axial end and a second axial end;

an ignition disposed at the first axial end;

a primer disposed at the second axial end; and a damper system disposed in the housing, the damper system comprising:

a firing pin spaced apart axially from the primer;

a moveable housing spaced apart axially from the ignition;

a fixed piston comprising a piston head disposed in the moveable housing and a first rod extending from the piston head axially, and outward from, the moveable housing, the fixed piston coupled to the housing; and a first spring disposed axially between the moveable housing and the firing pin, the damper system configured to initiate an inert time delay from the ignition receiving a pyrotechnic input to the primer sending a pyrotechnic output.

10. The inert time delay device of claim 9, wherein the damper system further comprises a release arm assembly configured to retain the firing pin in an axial position until the release arm assembly is released from the firing pin.

11. The inert time delay device of claim 10, wherein the release arm assembly releases the firing pin in response to the moveable housing engaging a release mechanism of the release arm assembly.

12. The inert time delay device of claim 10, wherein the release arm assembly releases the firing pin in response to the moveable housing travelling a first axial distance.

13. The inert time delay device of claim 12, wherein the first spring compresses in response to the moveable housing traveling the first axial distance.

14. The inert time delay device of claim 13, wherein the first spring expands, causing the firing pin to travel a second axial distance and engage the primer in response to the release arm assembly releasing the firing pin.

15. The inert time delay device of claim 9, wherein the moveable housing defines a hydraulic chamber configured to receive a working fluid.

16. The inert time delay device of claim 15, further comprising the working fluid disposed in the hydraulic chamber.

17. A method of manufacturing an inert time delay device, the method comprising:

coupling a release arm assembly to a first portion of a housing;

disposing a damper system in the first portion of the housing, the damper system comprising a moveable housing, a fixed piston, a first spring, a second spring, and a firing pin, the firing pin engaging the release arm assembly;

coupling a second portion of the housing to the first portion of the housing; and coupling a primer to the second portion of the housing.

18. The method of claim 17, wherein the first spring and the second spring extend axially from the moveable housing to the firing pin.

19. The method of claim 18, wherein the moveable housing comprises a hydraulic chamber disposed therein, the hydraulic chamber including a working fluid.

20. The method of claim 17, wherein coupling the release arm assembly to the first portion further comprises disposing a release arm spring radially through the housing to engage a release arm of the release arm assembly and coupling the release arm spring to the first portion of the housing.

* * * * *